US006812837B2

(12) United States Patent
Ikeuchi

(10) Patent No.: US 6,812,837 B2
(45) Date of Patent: Nov. 2, 2004

(54) AUTOMATIC DOOR SENSOR AND AUTOMATIC DOOR SYSTEM EQUIPPED WITH THIS SENSOR

(75) Inventor: Akihiro Ikeuchi, Ohtsu (JP)

(73) Assignee: Optex Co., Ltd., Shiga (JP)

( * ) Notice: Subject to any disclaimer, the term of this patent is extended or adjusted under 35 U.S.C. 154(b) by 0 days.

(21) Appl. No.: 10/300,017

(22) Filed: Nov. 20, 2002

(65) Prior Publication Data

US 2003/0093951 A1 May 22, 2003

(30) Foreign Application Priority Data

Nov. 22, 2001 (JP) ..... 2001-356810

(51) Int. Cl.[7] ..... G08B 13/08

(52) U.S. Cl. ..... 340/545.1; 340/545.3; 340/545.6; 340/545.9; 340/507; 340/691.6; 340/692

(58) Field of Search ..... 340/545.1, 545.3, 340/545.6, 545.9, 507, 691.6, 692

(56) References Cited

U.S. PATENT DOCUMENTS 5,793,281 A * 8/1998 Long ..... 340/384.1
5,986,561 A * 11/1999 Kuruvilla et al. ..... 340/691.5
6,392,537 B1 * 5/2002 Tazumi et al. ..... 340/507

FOREIGN PATENT DOCUMENTS

JP 2001-152750 6/2001

* cited by examiner

*Primary Examiner*—Daniel J. Wu
*Assistant Examiner*—Tai T. Nguyen
(74) *Attorney, Agent, or Firm*—Wenderoth, Lind & Ponack, L.L.P.

(57) ABSTRACT

An automatic door system capable of distinguishing between a door closing action for when an object leaves a prescribed area, which results from a "signal discontinuation due to the exit of an object", and a door closing action for when an object remains stationary within the area for a certain period of time, which results from a "forced signal discontinuation in the presence of a stationary object". Regarding the latter case, the automatic door system protects a person who stops in the area by setting the door to close at a low speed and/or issuing a vocal warning. The door closing action of the automatic door system can thereby reduce the risk of hitting the person with the door.

25 Claims, 4 Drawing Sheets

1. automatic door system
2. door
4. opening/closing mechanism
5. transom
6. door sensor
21. connection bracket
41. pulley
42. pulley
43. running belt
43a. lower span of running belt
43b. upper span of running belt
44. driving motor
45. controller
A - doorway opening
W - wall 1. automatic door system
2. door
4. opening/closing mechanism
5. transom
6. door sensor
21. connection bracket
41. pulley
42. pulley
43. running belt
43a. lower span of running belt
43b. upper span of running belt
44. driving motor
45. controller
A - doorway opening
W - wall 6. door sensor
61. casing
61a. transparent surface of casing
62. infrared emitter
63. infrared receiver 6. door sensor
7. speaker
44. driving motor
45. controller
61. casing
62. infrared emitter
63. infrared receiver
65. infrared sensor
66. open/close controller

AUTOMATIC DOOR SENSOR AND AUTOMATIC DOOR SYSTEM EQUIPPED WITH THIS SENSOR

BACKGROUND OF THE INVENTION

1. Field of the Invention

The present invention relates to an automatic door sensor and an automatic door system equipped with the automatic door sensor. In particular, the present invention is related to improving the reliability of door closing actions.

2. Description of the Related Art

As disclosed in Japanese Patent Laid-open Publication No. 2001-152750, etc., an automatic door system equipped with an active infrared sensor is traditionally known in the art. Such an infrared sensor comprises an emitter which projects infrared rays covering a prescribed area and a receiver which receives the infrared rays that are reflected from the infrared coverage area. If a person enters the infrared coverage area, the receiver receives a different pattern of infrared rays, whereupon the sensor thereby recognizes that a person is approaching the automatic door. Based on this recognition, the sensor transmits a detection signal to a door opening/closing mechanism so that a driving source (driving motor) of the automatic door is energized to open the door. After a person leaves the infrared coverage area, the receiver receives infrared rays in the normal pattern again. Then, the sensor discontinues transmitting a detection signal, and as a result, the driving source is energized to close the door.

Many of such active infrared sensors have a timed presence detection capability. Suppose a situation where a person or object has entered the infrared coverage area and remains stationary therein for a certain period of time, namely, where the pattern of infrared rays received by the receiver has changed and does not return to normal after a certain period of time. Under such circumstances, a sensor with the timed presence detection capability forcibly discontinues the transmission of a detection signal, and as a result, the driving source is energized to close the door. This feature effectively avoids a prolonged, unnecessary opening of the door, which is attributable to, for example, a plant or the like that is placed in the infrared coverage area.

In a conventional automatic door, a door member and the opening/closing mechanism of the door member constitute a single complete unit by themselves. In other words, activation of the opening/closing mechanism and consequent opening/closing actions of the door member are solely dependent on whether a detection signal from the sensor is received or not. For the opening/closing actions of the door, the opening speed and the closing speed can be set independently and may be different from each other. To be more specific, the door is closed if the transmission of the detection signal is discontinued due to a person exiting from the infrared coverage area (which is defined herein as "signal discontinuation due to the exit of an object"), or if the transmission of the detection signal is forcibly discontinued due to the continuous presence of a stationary object within the infrared coverage area for a certain period of time (which is defined herein as "forced signal discontinuation in the presence of a stationary object"). In whichever situation, it is conventional to close the door at a relatively high speed.

As mentioned above, provided that the "forced signal discontinuation in the presence of a stationary object" is attributable to a plant or like object that is placed in the infrared coverage area, there is no significant inconvenience in performing a relatively fast closing action at the same speed as in the case of the "signal discontinuation due to the exit of an object". Nevertheless, a person who stops in the infrared coverage area can also cause the "forced signal discontinuation in the presence of a stationary object". In this situation, if the door is closed by a relatively fast closing action at the same speed as in the case of "signal discontinuation due to the exit of an object", a person who, for example, stops around the door rail may not be able to escape from the relatively fast-moving door, which may result in the person being highly in danger of being struck by the door.

SUMMARY OF THE INVENTION

The present invention is made in view of the above-identified problem. With regard to an automatic door sensor having a timed presence detection capability, an object of the present invention is to provide an arrangement which is capable of preventing a person from being hit by a closing door when the door closing action results from the "forced signal discontinuation in the presence of a stationary object".

To achieve this object, the present invention distinguishes between a door closing action resulting from the "signal discontinuation due to the exit of an object" and a door closing action resulting from the "forced signal discontinuation in the presence of a stationary object". Particularly, the latter closing action is designed in consideration of the presence of a person within the area in such a manner so as to reduce the risk of hitting the person with the door.

Specifically, the present invention relates to an automatic door sensor which sends a door open signal to an automatic door opening/closing mechanism so as to open an automatic door when an object enters a prescribed area around a doorway opening of the automatic door. The automatic door sensor of the present invention also discontinues the transmission of a door open signal to the automatic door opening/closing mechanism so as to close the automatic door by a first closing action when the object leaves the prescribed area. The automatic door sensor is provided with an open/close controller for transmitting a presence detection signal to the automatic door opening/closing mechanism if the object remains stationary within the prescribed area for a certain period of time so as to close the automatic door by a second closing action which is different from the first closing action.

To be more specific, the second closing action resulting from the transmission of a presence detection signal includes the following operations. First, the automatic door is set to close at a reduced speed in comparison with the door closing speed of the first closing action that is to be performed when the object leaves the prescribed area. Second, a vocal warning which gives an advance notice of a closing door is outputted around the doorway opening of the automatic door.

Due to the slow closing action of the automatic door, when the automatic door starts the closing action despite the presence of a person who stops in the area, the person can notice that the door is closing in advance (i.e., before the door hits him/her). Even if the door may hit the person, the slowly closing door will not give a serious impact to the person. Further, a vocal warning that is issued around the doorway opening will also help the person to notice that the door is closing in advance.

Thus, the solution of the present invention distinguishes door closing actions between the one resulting from the "signal discontinuation due to the exit of an object" and the one resulting from the "forced signal discontinuation in the presence of a stationary object", and an automatic door system of the present invention adopts either door closing action which is suitable for a particular situation.

Furthermore, the automatic door system of the present invention may be composed of an automatic door sensor mentioned in the above-described solution and an automatic door opening/closing mechanism which closes the automatic door by either of the first and second closing actions depending on the status of a signal transmission outputted from the automatic door sensor.

DETAILED DESCRIPTION OF THE INVENTION

An embodiment of the present invention is hereinafter described with reference to the drawings.

Figure 1:
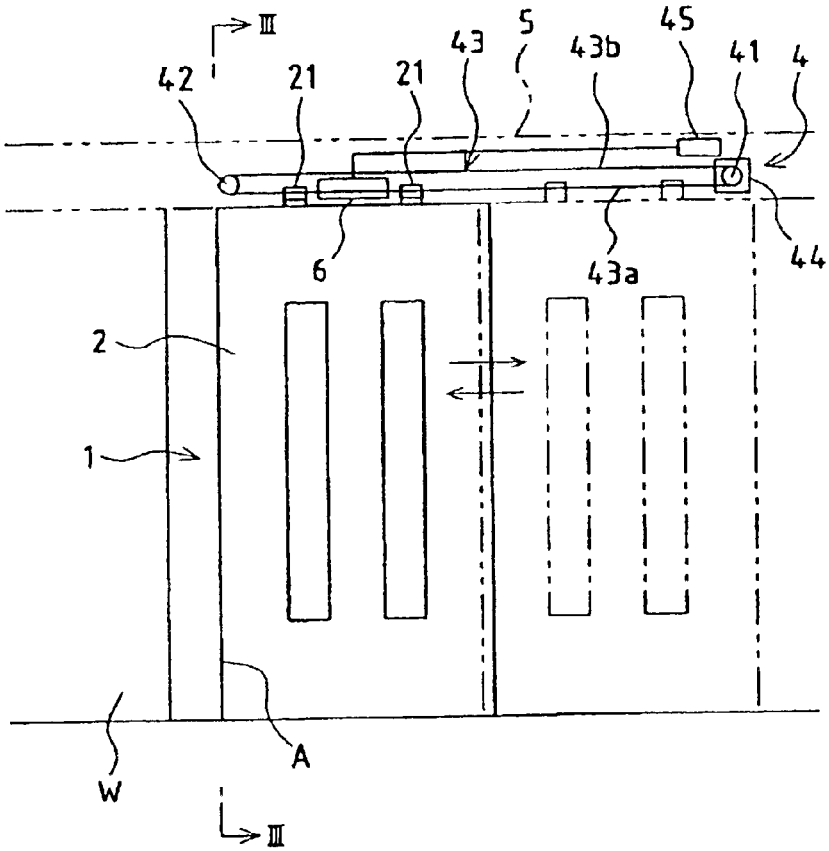
FIG. 1 is a front view showing the entire construction of the automatic door system according to an embodiment of the present invention.

FIG. 1 is a front view showing the entire construction of the automatic door system 1 according to the embodiment. The automatic door system 1 opens and closes a doorway opening A formed through a wall W. The automatic door system 1 is composed of a door 2 which slides (as indicated by the arrows in the example of FIG. 1) along a track extending parallel to the wall W (extending to the left and right in the example of FIG. 1), and an opening/closing mechanism 4 for allowing the sliding movement of the door 2. In FIG. 1, the doorway opening A is closed while the door 2 is located as depicted by the solid lines in FIG. 1, whereas the doorway opening A is open while the door 2 is located as depicted by the chain lines in FIG. 1.

The opening/closing mechanism 4 is housed inside a transom 5 (shown by phantom lines in FIG. 1) which defines the top edge of the doorway opening A. The opening/closing mechanism 4 is composed of a pair of pulleys 41, 42 which are spaced by a predetermined distance in the longitudinal direction of the transom 5, and a running belt 43 entrained over the pulleys 41, 42. The running belt 43 includes a lower span 43*a* and an upper span 43*b*. The lower span 43*a* is connected with two connection brackets 21, 21 which are provided on the top edge of the door 2. According to this arrangement, movement of the running belt 43 is followed by a sidewise sliding movement of the door 2 (to the left and right in the example of FIG. 1). As for the pulleys 41, 42, the rotation shaft of the pulley 41 (the right pulley in the example of FIG. 1) is linked with the driving shaft of a driving motor 44. When the driving motor 44 is driven, the pulley 41 rotates and moves the running belt 43, followed by sliding movement of the door 2.

Figure 2:
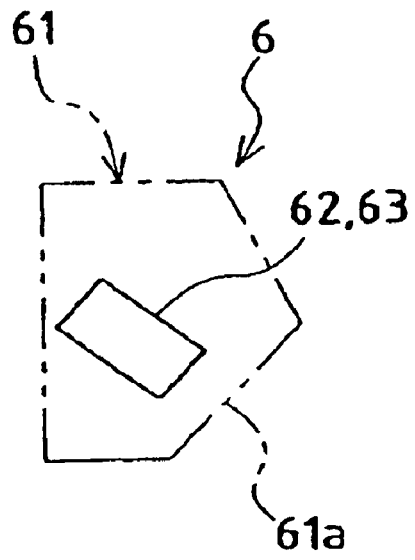
FIG. 2(*a*) shows an internal structure of the door sensor, and FIG. 2(*b*) illustrates the flow of a door open signal.
Figure 2:
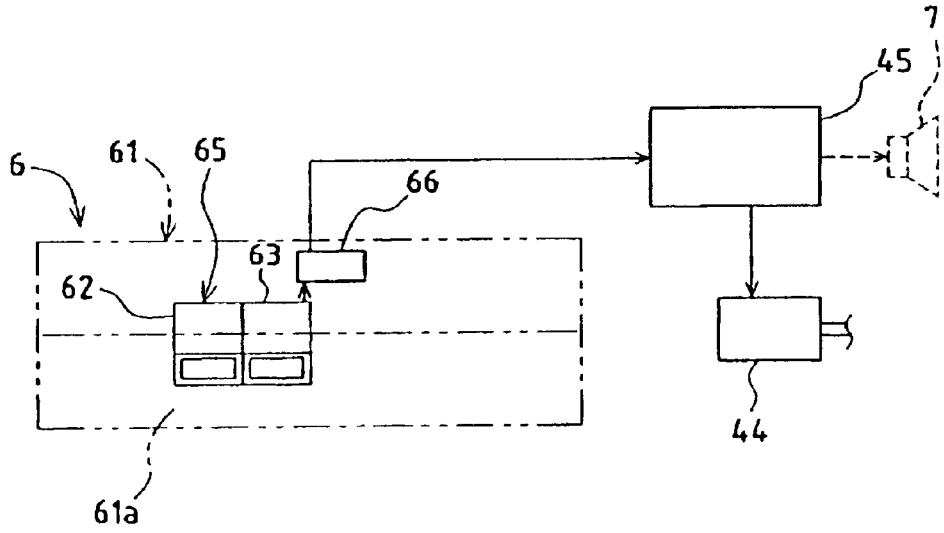
Figure 3:
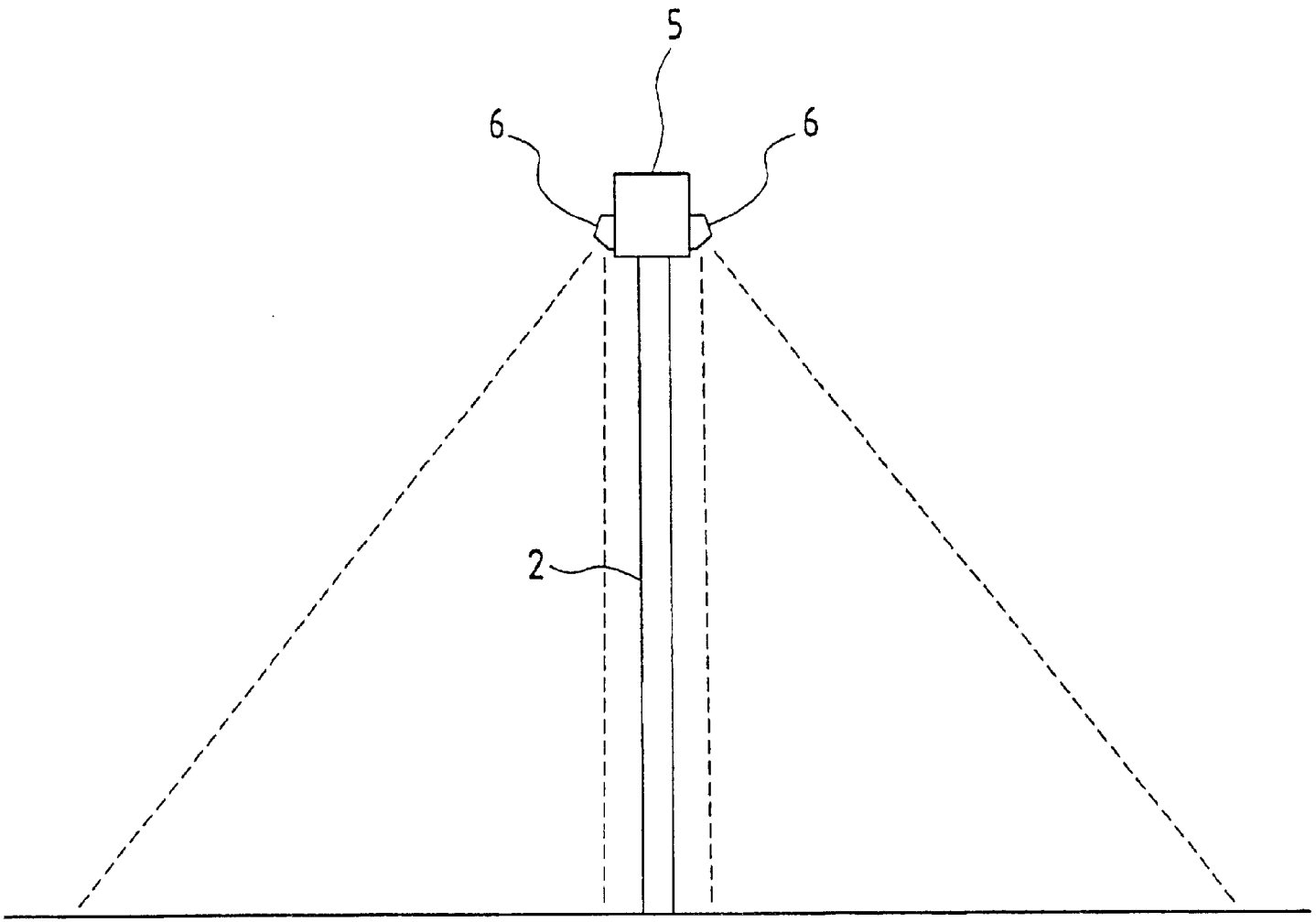
FIG. 3 is a sectional view taken along the line III—III in FIG. 1.

Turning to FIG. 3, door sensors 6, 6 are mounted on the sides of the transom 5. Acting as so-called activation sensors, each of the door sensors 6 produces a door open signal when the sensor 6 detects a person or object that is approaching the doorway opening A. FIG. 2(*a*) shows a side view of one of the door sensors 6, and FIG. 2(*b*) is a schematic front structural view thereof. As illustrated in FIG. 2(*b*), a door open signal produced by the door sensor 6 is sent to a controller 45 of the opening/closing mechanism 4.

Now, the structure of these door sensors 6, 6 is described in detail. Since the door sensors 6, 6 have an identical structure to one another, only one of the door sensors 6,6 is mentioned below.

Referring to FIG. 2(*a*), the door sensor 6 is composed of elements 62, 63 which are housed in a casing 61. In this casing 61, there is provided an external surface 61*a* which faces the elements 62, 63. The external surface 61*a* is a semi-transparent light emitting/receiving surface that allows for the transmission of light. Specifically, the elements housed in the casing 61 are an infrared emitter 62 and an infrared receiver 63. The infrared emitter 62 irradiates infrared rays to a prescribed area on the floor around the doorway opening A. FIG. 3 is a sectional view taken along the line III—III in FIG. 1, where the chain lines illustrated in FIG. 3 define infrared coverage areas of the infrared emitters 62 of the door sensors 6, 6.

The infrared receiver 63 is capable of receiving the light that is reflected from the infrared coverage area. When a person or object enters the area and causes a change in the amount of reflected light, the infrared receiver 63 recognizes the change as the presence of the person or object and produces a detection signal. Thus, the infrared emitter 62 and the infrared receiver 63 constitute the active infrared sensor 65 as a person or object detector.

The door sensor 6 is equipped with an open/close controller 66 which is capable of receiving a detection signal that is produced by the active infrared sensor 65. If there is a change in the amount of light that is received by the infrared receiver 63 (if the open/close controller 66 receives a detection signal), the open/close controller 66 sends a door open signal to the controller 45. Then, when the person leaves the area and the infrared receiver 63 receives reflected light in the normal pattern again, the open/close controller 66 discontinues the transmission of a door open signal.

Upon receiving a door open signal, the controller 45 rotates the driving motor 44 by a predetermined amount of rotation, thereby allowing for the door 2 to open. In contrast, upon a discontinuation of the transmission of a door open signal, the controller 45 rotates the driving motor 44 in the reverse direction, thereby allowing the door 2 to close.

The open/close controller 66 has a timed presence detection capability and internally contains a timer therefor. The open/close controller 66 is arranged to produce a presence detection signal on the condition that a person or object enters the area and remains stationary (i.e., causes no change in the amount of received light) for a certain period of time (on the condition that the timer of the open/close controller 66 starts counting upon a recognition of a stationary object and times out with the object holding the stationary state), which is the situation where the infrared receiver 63 starts to receive a different pattern of infrared rays and continues to do so for a certain period of time. Practically, there are two situations for the door 2 to be closed by the control operation of the open/close controller 66. One situation is where the transmission of a door open signal is discontinued after a person leaves the area. The other situation is where a presence detection signal is produced after an object remains stationary for a certain period of time.

With respect to the feature of this embodiment, the closing action of the door 2 is effected by the controller 45 in the following manners. First, in response to a discontinuation of the transmission of a door open signal, the controller 45 closes the door 2 by rotating the driving motor 44 at a relatively high speed. Second, upon receiving a presence detection signal, the controller 45 closes the door 2 by rotating the driving motor 44 at a relatively low speed. For example, the closing speed in the former situation is set to be substantially equal to the door opening speed, whereas the closing speed in the latter situation is set to be about half as fast as the door opening speed.

The following description is directed to the operation of the automatic door system 1 which is installed at the doorway opening A as described above.

While the door 2 is closed (as shown by the solid lines in FIG. 1), if a person approaches the doorway opening A and enters the infrared coverage area of the infrared emitter 62, the amount of received infrared rays received by the infrared receiver 63 changes. Based on this change, the door sensor 6 detects an approach of a person, and the open/close controller 66 sends a door open signal to the controller 45. Upon receiving the door open signal, the controller 45 drives the driving motor 44, thereby causing rotation of the pulley 41 (a counterclockwise rotation in the example of FIG. 1). In turn, the rotating pulley 41 moves the running belt 43, thereby allowing for the door 2 to slide in the opening direction (to the right in the example of FIG. 1). When the door 2 slides as far as the position indicated by the chain lines in FIG. 1, the controller 45 terminates the motion of the driving motor 44 and keeps the door 2 open. In the meantime, the person can pass through the doorway opening A.

After the person passes through the doorway opening A and leaves the infrared coverage area of the door sensors 6, 6, the door 2 is closed by a discontinuation of the transmission of a door open signal. In this case, the controller 45 rotates the driving motor 44 by a predetermined amount of rotation in the reverse direction (a clockwise rotation in the example of FIG. 1). This reverse motion causes the door 2 to slide in the closing direction (to the left in the example of FIG. 1). The speed of this sliding movement is relatively fast and is substantially equal to the sliding speed of the door opening action described above. After the door 2 reaches the position indicated by the solid lines in FIG. 1, the controller 45 terminates the motion of the driving motor 44 and keeps the door 2 closed. For convenience of description, this closing action is called a "first closing action".

On the other hand, according to the characteristic action of this embodiment, the door 2 is closed in a different manner when a person or object enters the infrared coverage area and remains stationary (i.e., causes no change in the amount of received light) for a certain period of time. In this case, the open/close controller 66 sends a presence detection signal to the controller 45. Upon receiving the presence detection signal, the controller 45 rotates the driving motor 44 in the same direction as in the first closing action but at a comparatively reduced speed. The slow-moving driving motor 44 leads to a slow sliding movement of the door 2 in the closing direction (to the left in the example of FIG. 1). When the door 2 reaches the position indicated by the solid lines in FIG. 1, the controller 45 terminates the motion of the driving motor 44 and keeps the door 2 closed. In contrast to the first closing action as defined above, this closing action is called a "second closing action".

According to this embodiment, if a person or object remains stationary within the infrared coverage area for a certain period of time, the door 2 is forcibly closed at a reduced speed. As a result, when the automatic door starts the closing action despite the presence of a person who stops in the infrared coverage area, the person can notice that the closing door is closing in advance (i.e., before the door hits him/her). Even if the door 2 may hit the person, the slowly closing door 2 will not give a serious impact on the person.

Further, the present invention encompasses a modified example concerning the second closing action by the controller 45 that is to be performed when a presence detection signal is transmitted from the open/close controller 66 to the controller 45. In the second closing action according to the previous embodiment, the closing speed of the door 2 is set at a low speed. Instead, according to this modified example, the automatic door system 1 is equipped with a speaker 7 as depicted by the broken lines shown in FIG. 2(*b*). Specifically, when the open/close controller 66 outputs a presence detection signal to the controller 45, the speaker 7 is allowed to produce a vocal output saying, for example, "The door is closing" so as to draw the attention of people around the area.

This modified arrangement maybe incorporated into the aforementioned embodiment. According to this combination, when the open/close controller 66 produces a presence detection signal, the door 2 closes slowly and the speaker 7 provides a vocal output simultaneously.

With regard to the opening/closing mechanism 4 for effecting an open/close movement of the door 2 along the track, the embodiment and the modified example of the present invention employ a mechanism that is composed of the driving motor 44, the pair of pulleys 41, 42, and the running belt 43. However, it is to be understood that the opening/closing mechanism 4 should not be limited to this structure.

In the embodiment and the modified example, the present invention is applied to the automatic door system 1 involving a single sliding door 2, but it is to be understood that the present invention should not be limited thereto. Additionally, the present invention is applicable to an automatic door system involving two doors. With respect to the type of automatic door(s), the present invention is applicable not only to the sliding door(s) but also to swing door(s) and revolving door(s).

Besides, in the embodiment and the modified example, the closing speed in the case of the "forced signal discontinuation in the presence of a stationary object" is set to be about half as fast as the closing speed in the case of the "signal discontinuation due to the exit of an object". However, the closing speed in the former case can be set optionally to be as fast or slow as the above-mentioned effect can be achieved.

As for the door sensors 6, it is possible to utilize microwave sensors, ultrasonic sensors, capacitance change-type sensors, and other various types of sensors.

The invention may be embodied in other specific forms without departing from the spirit or essential characteristics thereof. The above embodiments are therefore to be considered in all respects as illustrative and not restrictive, and the scope of the invention is indicated by the appended claims rather than by the foregoing description. All changes which come within the meaning and range of equivalency of the claims are therefore intended to be embraced therein.

This application is based on Patent Application No. 2001-356810 filed in Japan, the contents of which are incorporated hereinto by reference. Likewise, the contents of the reference cited hereinabove are incorporated hereinto by reference.

What is claimed is:

1. An automatic door sensor operable to transmit a door open signal to an automatic door opening/closing mechanism so as to open an automatic door when an object enters a prescribed area around a doorway opening of the automatic door, and to discontinue transmission of the door open signal to the automatic door opening/closing mechanism so as to close the automatic door by a first closing action when the object leaves the prescribed area, wherein said sensor comprises an open/close controller operable to transmit a presence detection signal to the automatic door opening/closing mechanism when the object remains stationary within the prescribed area for a certain period of time so as to close the automatic door by a second closing action which is different from the first closing action.

2. An automatic door sensor according to claim 1, wherein said open/close controller is operable to produce a presence detection signal for closing the automatic door at a reduced speed in comparison with a door closing speed in the first closing action to be performed when the object leaves the prescribed area.

3. An automatic door sensor according to claim 2, wherein said open/close controller is operable to produce a presence detection signal for outputting a vocal warning which is audible around the doorway opening of the automatic door so as to provide an advance notice of a closing automatic door.

4. An automatic door system which comprises an automatic door sensor according to claim 3, and an automatic door opening/closing mechanism which closes the automatic door by either of the first and second closing actions depending on whether said open/close controller transmits the presence detection signal to said automatic door opening/closing mechanism.

5. An automatic door system which comprises an automatic door sensor according to claim 2, and an automatic door opening/closing mechanism which closes the automatic door by either of the first and second closing actions depending on whether said open/close controller transmits the presence detection signal to said automatic door opening/closing mechanism.

6. An automatic door sensor according to claim 1, wherein said open/close controller is operable to produce a presence detection signal for outputting a vocal warning which is audible around the doorway opening of the automatic door so as to provide an advance notice of a closing automatic door.

7. An automatic door system which comprises an automatic door sensor according to claim 6, and an automatic door opening/closing mechanism which closes the automatic door by either of the first and second closing actions depending on whether said open/close controller transmits the presence detection signal to said automatic door opening/closing mechanism.

8. An automatic door system which comprises an automatic door sensor according to claim 1, and an automatic door opening/closing mechanism which closes the automatic door by either of the first and second closing actions depending on whether said open/close controller transmits the presence detection signal to said automatic door opening/closing mechanism.

9. An automatic door sensor operable to control an automatic door opening/closing mechanism to open/close an automatic door based on a presence of an object in a prescribed area around a doorway opening of the automatic door, said automatic door sensor comprising an open/close controller which is operable to:

transmit a door open signal to the automatic door opening/closing mechanism so as to control the automatic door opening/closing mechanism to open the automatic door when the object enters the prescribed area;

discontinue transmission of the door open signal to the automatic door opening/closing mechanism so as to control the automatic door opening/closing mechanism to close the automatic door by a first closing action when the object leaves the prescribed area; and transmit a presence detection signal to the automatic door opening/closing mechanism so as to control the automatic door opening/closing mechanism to close the automatic door by a second closing action which is different from the first closing action when the object remains stationary within the prescribed area for a certain period of time.

10. An automatic door sensor according to claim 9, wherein said open/close controller is operable to produce a presence detection signal for closing the automatic door at a reduced speed in comparison with a door closing speed in the first closing action to be performed when the object leaves the prescribed area.

11. An automatic door sensor according to claim 10, wherein said open/close controller is operable to produce a presence detection signal for outputting a vocal warning which is audible around the doorway opening of the automatic door so as to provide an advance notice of a closing automatic door.

12. An automatic door system which comprises an automatic door sensor according to claim 11, and an automatic door opening/closing mechanism which closes the automatic door by either of the first and second closing actions depending on whether said open/close controller transmits the presence detection signal to said automatic door opening/closing mechanism.

13. An automatic door system which comprises an automatic door sensor according to claim 10, and an automatic door opening/closing mechanism which closes the automatic door by either of the first and second closing actions depending on whether said open/close controller transmits the presence detection signal to said automatic door opening/closing mechanism.

14. An automatic door sensor according to claim 9, wherein said open/close controller is operable to produce a presence detection signal for outputting a vocal warning which is audible around the doorway opening of the automatic door so as to provide an advance notice of a closing automatic door.

15. An automatic door system which comprises an automatic door sensor according to claim 14, and an automatic door opening/closing mechanism which closes the automatic door by either of the first and second closing actions depending on whether said open/close controller transmits the presence detection signal to said automatic door opening/closing mechanism.

16. An automatic door system which comprises an automatic door sensor according to claim 9, and an automatic door opening/closing mechanism which closes the automatic door by either of the first and second closing actions depending on whether said open/close controller transmits the presence detection signal to said automatic door opening/closing mechanism.

17. An automatic door sensor operable to control an automatic door opening/closing mechanism so as to open/close an automatic door based on a presence of an object in a prescribed area around a doorway opening of the automatic door, said automatic door sensor comprising:

an infrared sensor operable to emit and receive infrared signals in the prescribed area so as to detect whether the object is present in the prescribed area; and an open/close controller operable to transmit a door open signal to the automatic door opening/closing mechanism when the object enters the prescribed area, to discontinue transmission of the door open signal to the automatic door opening/closing mechanism when the object leaves the prescribed area, and to transmit a presence detection signal to the automatic door opening/closing mechanism when the object remains stationary within the prescribed area for a certain period of time;

wherein said open/close controller is operable to control the automatic door opening/closing mechanism to open the automatic door by transmitting the door open signal to the automatic door opening/closing mechanism, to control the automatic door opening/closing mechanism to close the automatic door by a first closing action by discontinuing transmission of the door open signal to the automatic door opening/closing mechanism when the object leaves the prescribed area, and to control the automatic door opening/closing mechanism to close the automatic door by a second closing action which is different from the first closing action by transmitting the presence detection signal to the automatic door opening/closing mechanism when the object remains stationary within the prescribed area for the certain period of time.

18. An automatic door sensor according to claim 17, wherein said infrared sensor comprises an infrared emitter operable to emit the infrared signals in the prescribed area, and an infrared receiver operable to receive the infrared signals that are reflected from the prescribed area.

19. An automatic door sensor according to claim 17, wherein said open/close controller is operable to produce a presence detection signal for closing the automatic door at a reduced speed in comparison with a door closing speed in the first closing action to be performed when the object leaves the prescribed area.

20. An automatic door sensor according to claim 19, wherein said open/close controller is operable to produce a presence detection signal for outputting a vocal warning which is audible around the doorway opening of the automatic door so as to provide an advance notice of a closing automatic door.

21. An automatic door system which comprises an automatic door sensor according to claim 20, and an automatic door opening/closing mechanism which closes the automatic door by either of the first and second closing actions depending on whether said automatic door sensor discontinues the transmission of the door open signal or transmits the presence detection signal to said automatic door opening/closing mechanism.

22. An automatic door system which comprises an automatic door sensor according to claim 19, and an automatic door opening/closing mechanism which closes the automatic door by either of the first and second closing actions depending on whether said automatic door sensor discontinues the transmission of the door open signal or transmits the presence detection signal to said automatic door opening/closing mechanism.

23. An automatic door sensor according to claim 17, wherein said open/close controller is operable to produce a presence detection signal for outputting a vocal warning which is audible around the doorway opening of the automatic door so as to provide an advance notice of a closing automatic door.

24. An automatic door system which comprises an automatic door sensor according to claim 23, and an automatic door opening/closing mechanism which closes the automatic door by either of the first and second closing actions depending on whether said automatic door sensor discontinues the transmission of the door open signal or transmits the presence detection signal to said automatic door opening/closing mechanism.

25. An automatic door system which comprises an automatic door sensor according to claim 17, and an automatic door opening/closing mechanism which closes the automatic door by either of the first and second closing actions depending on whether said open/close controller transmits the presence detection signal to said automatic door opening/closing mechanism.

* * * * *

UNITED STATES PATENT AND TRADEMARK OFFICE
Certificate

Patent No. 6,812,837 B2 Patented: November 2, 2004

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Akihiro Ikeuchi, Ohtsu, (JP); and Toru Ohmae, Ohtsu, (JP).

Signed and Sealed this Third Day of April 2007.

DANIEL WU
*Supervisory Patent Examiner*
Art Unit 2612